US006467242B1

(12) United States Patent
Huang

(10) Patent No.: US 6,467,242 B1
(45) Date of Patent: Oct. 22, 2002

(54) HEAT-SEALING APPARATUS

(76) Inventor: Chiou Shiang Huang, Shin Hay Road, Taipei (TW)

( * ) Notice: Subject to any disclaimer, the term of this patent is extended or adjusted under 35 U.S.C. 154(b) by 0 days.

(21) Appl. No.: 09/858,007

(22) Filed: May 14, 2001

(51) Int. Cl.[7] ..... B65B 31/06
(52) U.S. Cl. ..... 53/512; 53/374.9
(58) Field of Search ..... 53/512, 374.9, 53/374.8, 375.6, 434, 384.1

(56) References Cited

U.S. PATENT DOCUMENTS 2,672,268 A * 3/1954 Bower ..... 206/524.8
4,765,125 A * 8/1988 Fafournoux ..... 53/374.9
5,048,269 A * 9/1991 Deni ..... 53/374.9
5,406,776 A * 4/1995 Cappi et al. ..... 53/373.6
5,638,664 A * 6/1997 Levsen et al. ..... 53/372.6
5,893,822 A * 4/1999 Deni et al. ..... 493/256
6,244,023 B1 * 6/2001 Lataix ..... 414/412
6,256,968 B1 * 7/2001 Kristen ..... 53/405

* cited by examiner

*Primary Examiner*—Rinaldi I. Rada
*Assistant Examiner*—Paul Durand
(74) *Attorney, Agent, or Firm*—Pro-Techtor International Services

(57) ABSTRACT

A heat-sealing apparatus includes a packing bag stretcher adapted to stretch open the mouth of the loaded packing bag, and a vacuum pump adapted to draw air out of the loaded packing bag before sealing the loaded packing bag.

2 Claims, 5 Drawing Sheets

HEAT-SEALING APPARATUS

BACKGROUND OF THE INVENTION

The present invention relates to a heat-sealing apparatus and, more particularly, to such a heat-sealing apparatus, which draws air out of the packing bag when sealing it.

In order to keep food fresh, a polymeric packing bag may be used to seal food, and a vacuum pump may be used to draw air out of the packing bag when sealing it. Because the top and bottom side edges of the mouth of a polymeric packing bag are normally closely attached to each other, it takes much time to open the mouth and to keep the mouth open when drawing air out of the packing bag. U.S. Pat. No. Re,34,929 discloses a packing bag 1 for use with a vacuum pump 12. The packing bag 1 has intersected ribs 11 on the inner surface around the mouth. Because of the presence of the intersected ribs 11, the mouth of the packing bag 1 can easily be opened. However, the manufacturing cost of this particularly designed packing bag 1 is high.

SUMMARY OF THE INVENTION

It is the main object of the present invention present invention to provide a heat-sealing apparatus, which draws air out of the packing bag when sealing it. According to one aspect of the present invention, the bottom shell of the heat sealing apparatus has a top center recess, and a packing bag stretcher supported on a compression spring in the top center recess and adapted to stretch open the mouth of the loaded packing bag for enabling a vacuum pump to draw air out of the loaded packing bag when sealing it. According to another aspect of the present invention, the packing bag stretcher comprises a bearing plate supported on the compression spring, a press plate suspending above the bearing plate for pressing the bottom side edge of the mouth of the loaded packing bag on the bearing plate, two L-shaped clamping plates disposed at two sides of the bearing plate and adapted to clamp the mouth of the loaded packing bag on the press plate, and two torsional springs respectively connected between two sides of the gearing plate and the two L-shaped clamping plates. According to still another aspect of the present invention, the bearing plate has a transversely extended air hole connected to the vacuum pump in the bottom shell by a suction tube for enabling the vacuum pump to draw air out of the loaded packing bag.

DETAILED DESCRIPTION OF THE PREFERRED EMBODIMENT

Figure 1:
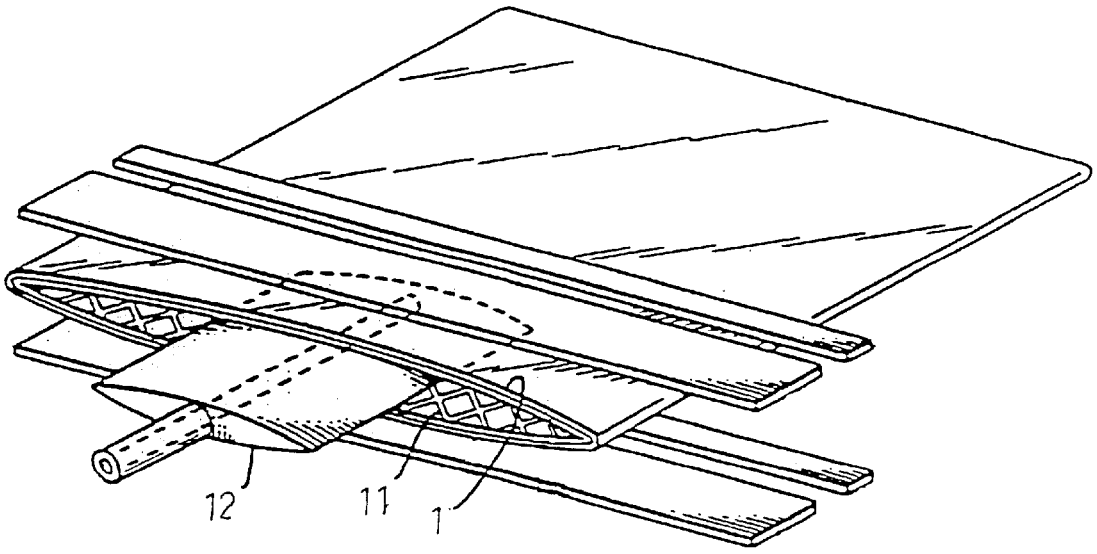
FIG. 1 PRIOR ART
FIG. 1 illustrates the application of a polymeric packing bag according to the prior art.
Figure 2:
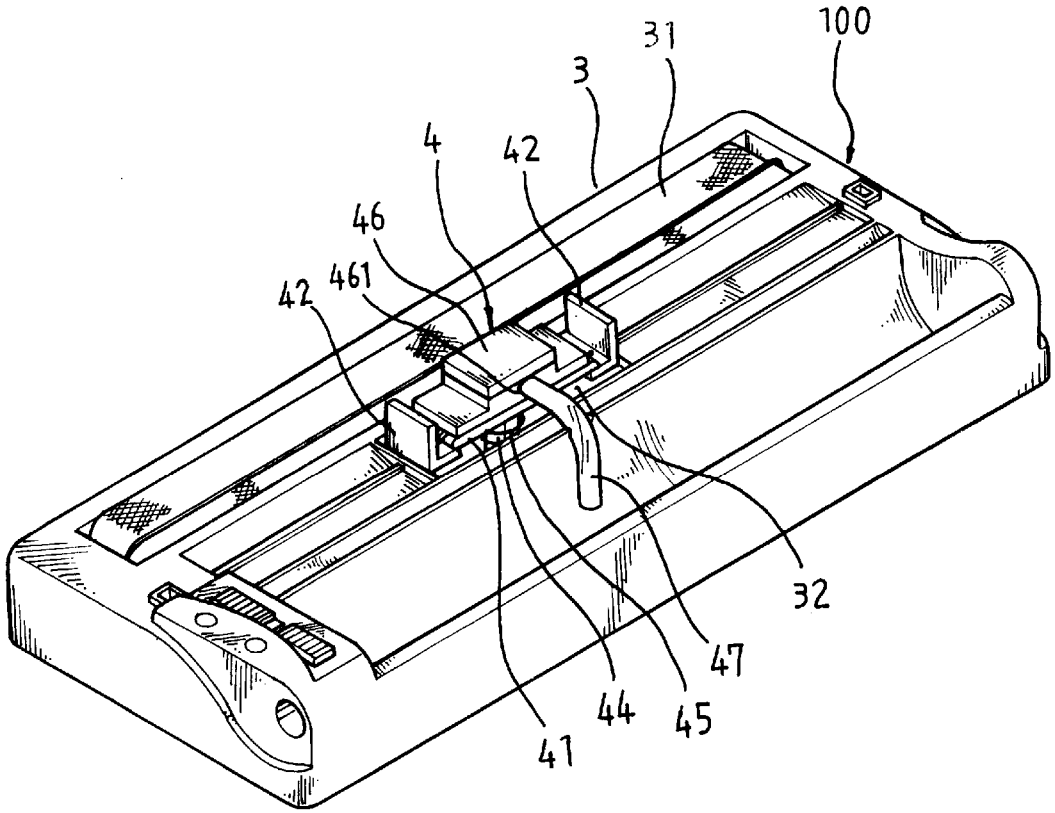
FIG. 2 is a perspective view of a heat-sealing apparatus according to the present invention (the top shell excluded).
Figure 3:
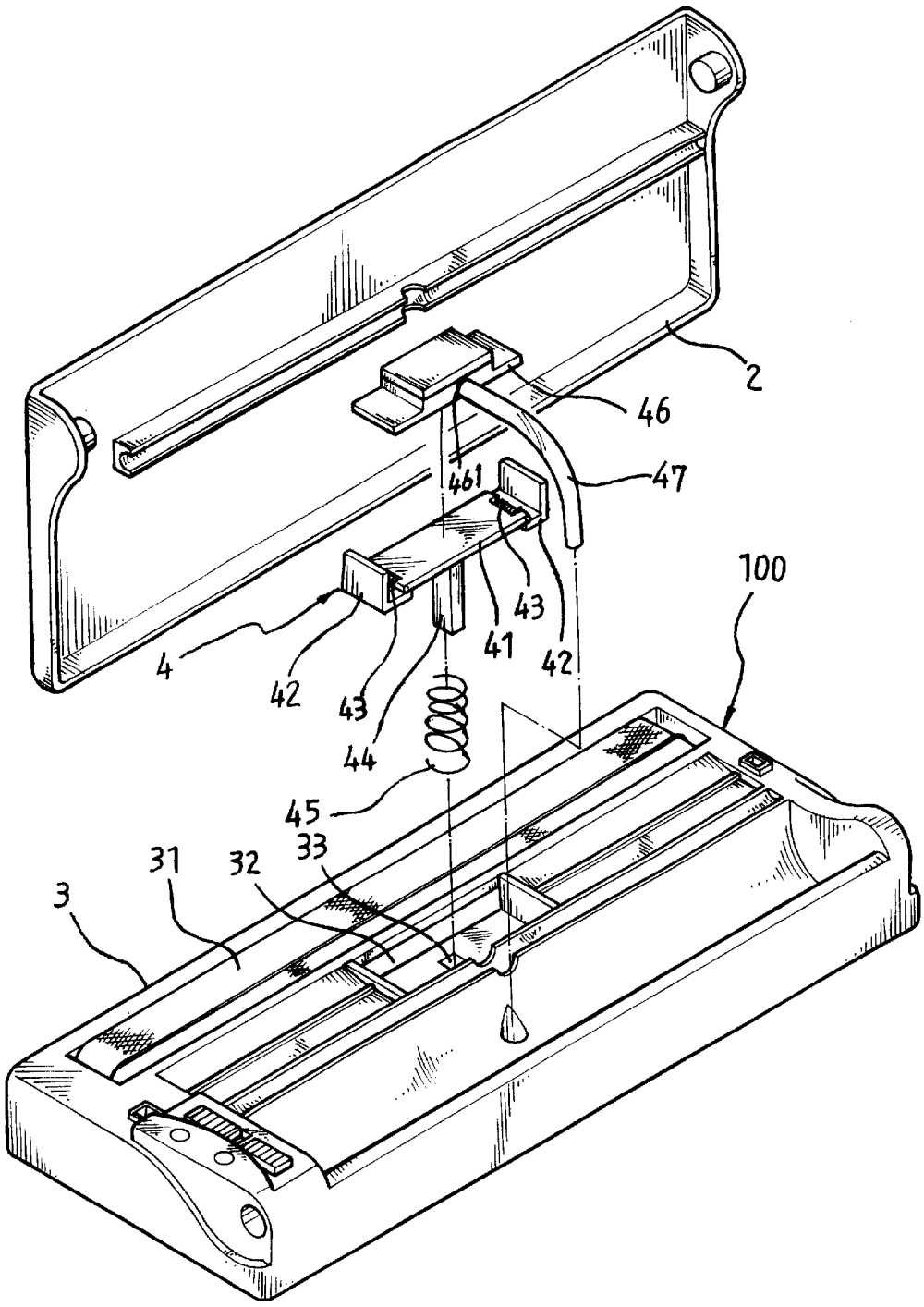
FIG. 3 is an exploded view of the heat-sealing apparatus according to the present invention.
Figure 4:
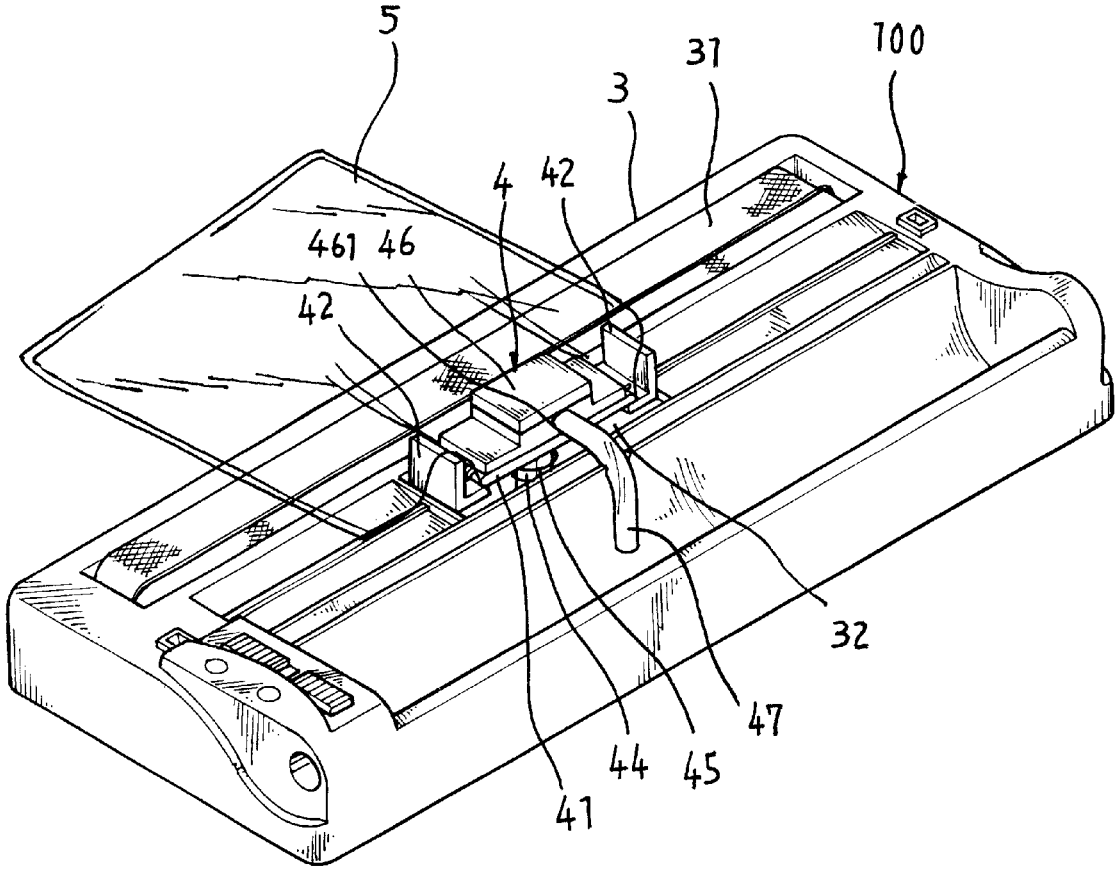
FIG. 4 illustrates a polymeric packing bag loaded in the packing bag stretcher according to the present invention.
Figure 5:
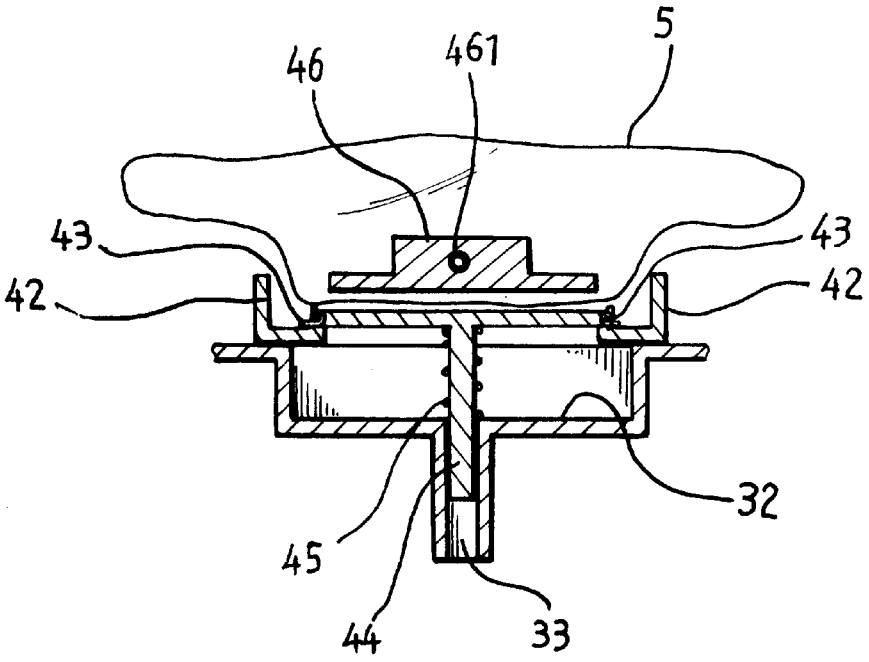
FIGS. 5 and 6 illustrate a cross sectional view of the packing bag stretcher.
Figure 6:
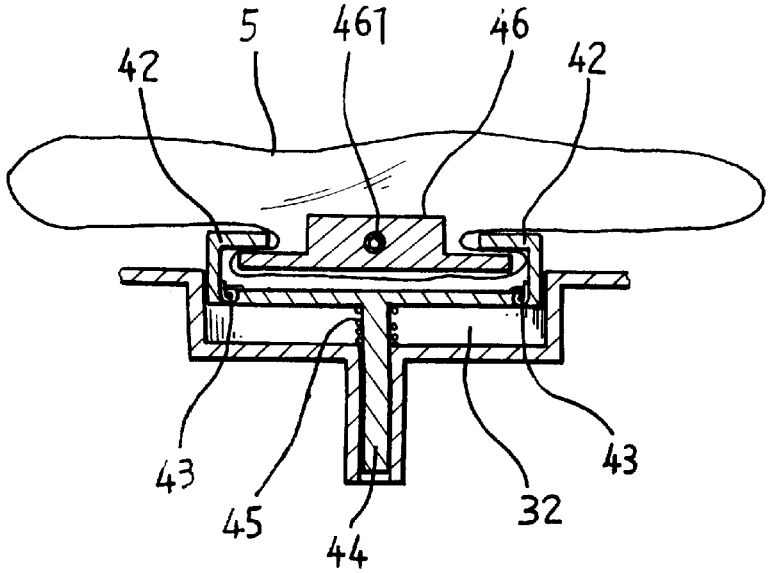

Referring to FIGS. 2 and 3, a heat-sealing apparatus in accordance with the present invention comprises a body 100 formed of a top shell 2 and a bottom shell 3. The top shell 2 is hinged to the bottom shell 3. An electric heating element

31 is provided in the bottom shell 3 near its front side. The bottom shell 3 has a top center recess 32, and a through hole 33 in the top center recess 32. A packing bag stretcher 4 is installed in the bottom shell 3. The packing bag stretcher 4 comprises a bearing plate 41, the bearing plate 41 having a vertical bottom rod 44 inserted into the through hole 33 in the top center recess 32 of the bottom shell 3, a compression spring 45 sleeved onto the vertical bottom rod 44 of the bearing plate 41 and supported between the top center recess 32 and the bearing plate 41, two L-shaped clamping plates 42 disposed at two sides of the bearing plate 41, two torsional springs 43 respectively connected between two sides of the bearing plate 41 and the L-shaped clamping plates 42 to hold the L-shaped clamping plates 42 in the non-clamping position, and a press plate 46 suspending above the bearing plate 41. The press plate 46 has a transversely extended air hole 461. A vacuum pump (not shown) is installed in the bottom shell 3, having a suction tube 47 connected to the air hole 461 of the press plate 46. Further, the size of the bearing plate 41 is slightly smaller than the top center recess 32 of the bottom shell 3. When assembled, the L-shaped clamping plates 42 are respectively aimed at two opposite vertical sidewalls of the top center recess 32 of the bottom shell 3.

Referring to FIGS. from 4 through 6, when sealing a polymeric packing bag 5, the bottom side edge of the mouth of the packing bag 5 is attached to the bottom side of the press plate 46 and the top side edge of the mouth of the packing bag 5 is attached to the top side of the press plate 46, and then the top shell 2 is pressed on the bottom shell 3 to force the press plate 46 downwards against the packing bag stretcher 4. When pressing the press plate 46 on the packing bag stretcher 4, the bearing plate 41 is lowered to compress the compression spring 45, and the L-shaped clamping plates 42 are forced by the two opposite vertical sidewalls of the top center recess 32 of the bottom shell 3 to turn inwards toward each other and to clamp the mouth of the packing bag 5 on the press plate 46, and at the same time, the vacuum pump in the bottom shell 3 is started to draw air out of the packing bag rapidly. When lowering the top shell 3 to the lower limit position, the top shell 3 gives a pressure to the packing bag 5 against the electric heating element 31, and therefore the packing bag 5 is sealed when a vacuum is produced in the packing bag 5.

A prototype of heat-sealing apparatus has been constructed with the features of FIGS. 2~6. The heat-sealing apparatus functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A heat-sealing apparatus of the type comprising a bottom shell, an electric heating element fixedly mounted in said bottom shell near a front side of said bottom shell, and a top shell hinged to the bottom shell and adapted to press a loaded packing bag on said electric heating element for enabling the loaded packing bag to be sealed by heat, wherein said bottom shell comprises a top center recess, a through hole in said top center recess, a packing bag stretcher mounted in said top center recess and adapted to stretch open the mouth of the packing bag being loaded in said bottom shell, said packing bag stretcher comprising a bearing plate, said bearing plate having a vertical bottom rod inserted into said through hole in said top center recess, a compression spring sleeved onto the vertical bottom rod of said bearing plate and supported between said top center recess and said bearing plate, a press plate suspending above said bearing plate, said press plate having a transversely extended air hole, a suction tube extended from said air hole and connected to a vacuum pump installed in said bottom shell for enabling said vacuum pump to draw air out of the packing bag being loaded in said bottom shell, and two L-shaped clamping plates disposed at two sides of said bearing plate and adapted to clamp the mouth of the loaded packing bag on said press plate.

2. The heat-sealing apparatus of claim 1 wherein two torsional springs are respectively connected between two sides of said bearing plate and said L-shaped clamping plates.

* * * * *